US009095174B2

(12) United States Patent
Capuano

(10) Patent No.: US 9,095,174 B2
(45) Date of Patent: Aug. 4, 2015

(54) ELECTRONIC HOOKAH

(75) Inventor: Sammy Capuano, North Miami Beach, FL (US)

(73) Assignee: SIS RESOURCES LTD., Bet Shemesh (IL)

( * ) Notice: Subject to any disclaimer, the term of this patent is extended or adjusted under 35 U.S.C. 154(b) by 0 days.

(21) Appl. No.: 13/578,732

(22) PCT Filed: Dec. 20, 2010

(86) PCT No.: PCT/US2010/061294

§ 371 (c)(1),
(2), (4) Date: Aug. 13, 2012

(87) PCT Pub. No.: WO2011/075722

PCT Pub. Date: Jun. 23, 2011

(65) Prior Publication Data

US 2013/0032159 A1 Feb. 7, 2013

Related U.S. Application Data

(60) Provisional application No. 61/288,299, filed on Dec. 20, 2009.

(51) Int. Cl.
*A24F 47/00* (2006.01)
*A24F 1/30* (2006.01)

(52) U.S. Cl.
CPC ..... *A24F 1/30* (2013.01); *A24F 47/008* (2013.01)

(58) Field of Classification Search
CPC ..... A24F 1/30
See application file for complete search history.

(56) References Cited

U.S. PATENT DOCUMENTS

| | | | | |
|---|---|---|---|---|
| 4,275,747 | A * | 6/1981 | Miller | 131/195 |
| 5,388,594 | A * | 2/1995 | Counts et al. | 131/329 |
| 5,865,186 | A * | 2/1999 | Volsey, II | 131/194 |
| 6,089,857 | A * | 7/2000 | Matsuura et al. | 431/142 |
| 6,806,682 | B2 * | 10/2004 | Hsiao | 320/107 |
| 7,404,405 | B1 | 7/2008 | Mehio | |
| 2005/0279371 | A1 | 12/2005 | Billard | |
| 2009/0065011 | A1 * | 3/2009 | Maeder et al. | 131/194 |
| 2009/0084391 | A1 | 4/2009 | Krupp | |
| 2009/0283103 | A1 * | 11/2009 | Nielsen et al. | 131/273 |
| 2009/0301502 | A1 | 12/2009 | Mehio | |
| 2011/0041848 | A1 * | 2/2011 | Stone et al. | 128/203.14 |

* cited by examiner

*Primary Examiner* — Richard Crispino
*Assistant Examiner* — Eric Yaary
(74) *Attorney, Agent, or Firm* — Harness, Dickey & Pierce, P.L.C.

(57) ABSTRACT

Disclosed are various embodiments of an electronic hookah. In some embodiments, the electronic hookah comprises a body, a power supply, and one or more smoking units having a smoking device, a connection socket, a tube, an air flow switch, and a power connector. The tube is disposed between the connection socket and the air flow switch, and the smoking device is releasably attached to the connection socket. Further, the power supply provides power to the connection socket over the power connector, and the connection socket provides power to the smoking device to produce smoke or vapor. The smoking device may comprise an atomizer and smoke juice containing flavorings, coloring agents, nicotine, and/or a vaporizing base.

19 Claims, 2 Drawing Sheets

ELECTRONIC HOOKAH

STATEMENT REGARDING FEDERALLY SPONSORED RESEARCH OR DEVELOPMENT

There is no federal government sponsorship associated with this invention.

TECHNICAL FIELD

The invention relates to electronic smoking products in general, and more particularly to an electronic hookah device.

BACKGROUND ART

As anti-smoking legislation gains momentum across the globe, businesses such as bars, restaurants, and other such entertaimnent establishments have been forced to ban smoking products from their premises, harming their profitability and diminishing their overall entertainment value. Electronic cigarettes, which closely mimic regular cigarettes, provide several unchallenged benefits when compared head-on to cigarettes. Such benefits may include the absence of tar, odor, ash, pollution, and combustion by-products. As such, there is a marked desire for a smoking alternative that is socially acceptable and that complies with anti-smoking legislation while still providing consumers with a satisfying smoking experience.

A traditional "hookah" is typically a single or multi-stemmed, often glass-based, instrument for smoking tobacco, whereby the smoke is cooled and filtered by passing through water. Traditional hookahs utilize flavored tobacco products as the primary smoking product and can usually only burn one flavor or type of tobacco at a time. With that in mind, utilizing an electronic smoke-producing mechanism in place of the tobacco or incense material in a traditional hookah provides recognizable benefits to the individual smoker and to the overall social experience. For one, a greater variety of smoke can be produced (i.e. flavor, color, volume, etc. . . . ). Additionally, individual smokers who are using the hookah simultaneously can each choose a different type and/or flavor of smoke. Finally, the type of smoke to be produced can be changed easily at any time during use, without finishing or prematurely disposing of the previous smoking material as is required with a traditional hookah.

DISCLOSURE OF THE INVENTION

The present invention discloses a system for an electronic hookah, in which one or more users may concurrently smoke by inhaling smoke or vapor produced by the electronic hookah.

In some embodiments of the present invention, the electronic hookah comprises a body; one or more smoking tubes or hoses attached to the body; one or more electronic smoking devices, wherein the electronic smoking device is connected to the tube through a connector socket; one or more air flow switches; and a primary power supply.

In some embodiments of the present invention, the electronic hookah further comprises a light contained within the body.

In some embodiments of the present invention, the electronic hookah further comprises an electronic smoking device and connector socket at the end of each smoking tube.

In some embodiments of the present invention, the electronic hookah further comprises a power connector contained within each smoking tube, wherein the power connecter provides power from the primary power supply to the smoking device at the end of the smoking tube.

In some embodiments of the present invention, the electronic hookah further comprises a single electronic smoking device and connector socket contained within the body.

In some embodiments of the present invention, the electronic hookah further comprises an air-flow junction connector.

In some embodiments of the present invention, the electronic hookah further comprises a flow regulator connected to each smoking tube.

In some embodiments of the present invention, the smoking tube is retractable into the body.

In some embodiments of the present invention, the smoking device comprises an atomizer and a container of smoke juice. For purposes of this disclosure, smoke juice is defined as a composition containing flavorings, coloring agents, nicotine, and/or a vaporizing base such as glycol, propylene glycol, or other like substances.

In some embodiments, the atomizer and smoke juice container are configured as a single disposable cartridge referred to as a "cartomizer" In other embodiments, the atomizer and smoke juice container are discrete components wherein the smoke juice container is disposable and detachable from a reusable atomizer.

In some embodiments of the present invention, the smoking device generates smoke or vapor from the smoke juice when electrical power is applied to the atomizer, in a manner similar to the operation of electronic cigarettes known in the art.

In some embodiments of the present invention, the electronic smoking device is capable of producing smoke having various flavorings and colors, varying amounts of nicotine, various medicinal substances, and combinations thereof.

In some embodiments of the present invention, the primary power supply is contained within the body and may be a USB power supply, a replaceable battery, a rechargeable battery, or a crank-recharged battery In some embodiments of the present invention, the prim ary power supply is connected to a secondary power supply via a second connector.

In some embodiments of the present invention, the secondary power supply is connected to a wall outlet, cigarette lighter socket in a vehicle, power converter or similar power source.

In some embodiments of the present invention, the second connector is retractable into the body.

In some embodiments of the present invention, the body has the shape of a traditional hookah. Alternatively, the body is a flat or compact shape to make it easier to carry and store. Further, the body can be retracted telescopically to make it easier to carry and store.

Reference is now made to FIG. 1 which is a schematic of one embodiment of the electronic hookah of the present invention, constructed and operative in accordance with embodiments of the invention wherein each individual concurrent user has a separate smoking device. Electronic hookah 100 is shown as having a body 102 connected to one or more individual electronic smoking units 103. Smoking unit 103 preferably includes an individual and disposable electronic smoking device 104 (which may be a cartridge consisting of an atomizer and smoke juice), a connection socket 105, a tube 106, an air-flow switch 107, and a power connector 109. Connection socket 105 allows smoking device 104 to be held in place at the end of tube 106 while in use, and allows smoking device 104 to be released and replaced. A central power supply 110 provides power to connection socket 105 over power connector 109, which in turn powers smoking device 104. In some embodiments, power supply 110 may be an AC to DC power converter, a universal serial bus (USB) power supply, a replaceable or rechargeable battery, or a combination thereof.

In some embodiments, smoking device 104 (and smoking device 213, discussed below) comprises a cartridge containing smoke juice and an atomizer. The smoke juice, as described above, is a composition that may contain flavorings, coloring agents, nicotine, and/or a vaporizing base. The atomizer is an electrical device comprised of a heating element that when placed in contact with smoke juice, causes the smoke juice to vaporize, thereby forming a smoke-like vapor. Accordingly, when the atomizer is triggered (by air-flow switch 107 or other means), it heats and atomizes the smoke juice, generating smoke and/or vapor which is inhaled by the user though a central bore disposed within smoking device 104 (or 213). Accordingly, in some embodiments, like that in FIG. 1, the distal end of smoking device 104 also functions as a mouthpiece for the user.

In some embodiments, the atomizer and smoke juice container are configured as a single disposable cartridge referred to as a "cartomizer." in other embodiments, the atomizer and smoke juice container are discrete components wherein the smoke juice container is disposable and detachable from a reusable atomizer. Accordingly, in the "cartomizer" configuration, smoking device 104 (or 213) is a single piece that releasably engages connection socket 105 (or 208, described below). In the alternative configuration, smoking device 104 (or 213) is a two-piece device wherein the atomizer is releasably engaged with the connection socket 105 for 208) and the smoke juice container is releasably engaged with the atomizer.

Disposable smoking device 104 is attached to connection socket 105 in a manner to enable a user to inhale from device 104, which in turn momentarily closes the circuit within air-flow switch 107 (whereas 107 may reside at any point within tube 106 or within body 102), thereby sending power through connection socket 105 to the atomizer within smoking device 104, which triggers the atomization process to produce smoke or vapor. Optionally, the air-flow switch 107, when activated by inhalation, may simultaneously trigger light controller 111 to send momentary power to light 116. The functionality of the various air flow switch 107 embodiments is discussed below.

Further, smoking unit 103 may be permanently connected to body 102, or may be detachably connected via a socket that provides a power connection from power supply 110 to power connecter 109 and, if air-flow switch 107 is located inside body 102, an air-flow connection from air-flow switch 107 to tube 106. It may be noted that hookah 100 is configured for use by one or more concurrent users via one or more smoking units 103, each of which is connected to, and receives power from power supply 110.

Reference is now made to FIG. 2 which is another embodiment of the electronic hookah of the present invention, constructed and operative in accordance with embodiments of the invention wherein all concurrent users share a single smoking device. Shown is electronic hookah 200 having a body 202 connected to one or more individual electronic smoking tubes 203. Smoking tube 203 preferably includes an individual and disposable mouthpiece 217, air tube 206, and will either be connected to or contain within it air flow switch 214. Smoking tube 203 may be permanently connected to body 202, or may be detachably connected via a socket that provides air-flow through flow switch 214 to tube 203. Each tube 203 is connected to (or contains at any point within it) an air flow switch 214, and, optionally, a check valve 219 which functions as a flow regulator that allows air to flow through tube 203 only towards the user and not away from the user. Alternatively, air flow switch 214 may also function as a check valve itself. As shown one or more air flow switches 214 may be connected to a central air-flow junction connector 205. The air-flow junction connector 205 is connected via air flow tube 201 to electronic smoking device 213, through connection socket 208. The various embodiments of electronic smoking device 213 are described above.

In some embodiments, connection socket 208 allows smoking device 213 to be held in place in body 202 while in use, and allows smoking device 213 to be released and replaced. Accordingly, connection socket 208 is configured with a central bore such that the vapor emitted from smoking device 213 passes through connection socket 208 to tube 203. Accordingly, while the embodiment in FIG. 1 contemplates that vapor from smoking device 104 exits in the direction away from connection socket 105 (and directly into the user's mouth upon inhalation), some embodiments, like that in FIG. 2, have the reverse configuration, wherein the vapor emitted from smoking device 213 passes through the connection socket, into air-flow junction 205 then through the air flow switch 214, up smoking tube 203 and into the user's mouth upon inhalation. In other words, in the embodiment in FIG. 1, vapor is inhaled directly from smoking device 104. In the embodiment in FIG. 2, vapor is inhaled from tube 203.

Connection socket 208 also provides power to smoking device 213 from a central power supply 210, such as an AC to DC power converter, a universal serial bus (USB) power supply, a replaceable or rechargeable battery, or a combination thereof, which device 213 is preferably configured to receive power from. It is understood that smoking device 213 can be located anywhere on or can be disposed anywhere within the body of the electronic hookah 200 and, in some embodiments, may be located at a top portion thereof, where the tobacco material is found in traditional hookahs (for example, near or next to light 216).

Tube 203 is connected through air flow switch 214, air-flow junction connector 205, air flow tube 201, and connection socket 208, to smoking device 213 in a manner to enable a user to inhale from tube 203 using mouthpiece 217, which in turn momentarily closes the circuit within air-flow switch 214, thereby sending power to the atomizer within smoking device 213 to produce smoke or vapor, while optionally simultaneously operating light controller 211 to send momentary power to light 216. Light controller 211 can be set to illuminate light 216 in a unique color for each respective user upon inhalation, and yet a different color upon simultaneous inhalation.

Additionally, because in this embodiment, vapor produced by smoking device 213 flows through tube 203 (as compared to the embodiment in FIG. 1 wherein vapor is inhaled directly from smoking device 104), vapor condensation could form on the walls of tube 206 and drain down to the air flow switch 214, thereby causing the air flow switch to become polluted or clogged. Accordingly hookah 200 may optionally have a liquid filter or drainage tray 220 disposed above air flow switch 214, in order to collect condensed electronic vapor, to prevent the condensation from clogging or polluting air flow switch 214.

In both the embodiments illustrated in FIGS. 1 and 2, power supplies 110 and 210 is preferably situated internally to hookah 100 and 200, respectively, for example inside body 102 as shown in FIG. 1. Additionally, the power supplies may be configured to receive power from a secondary power supply 212, such as a wall outlet, a power converter, a cigarette lighter outlet such as that found in a vehicle, or a USB connection on a computer or other source, to which power supply 110 or 210 is connected via a connector 218. To that end, where power supply 110 or 210 is a rechargeable battery, secondary power supply 212 can be used as a detachable charging device, lending to the portability of the device.

For purposes of this disclosure, there are several embodiments of air flow switches 107 and 214. One such example is a typical air flow switch having a bore with a metal diaphragm disposed therein. When a user inhales causing a pressure change, the diaphragm deforms under the pressure and comes in contact with another rigid metal plate, closing the circuit and sending power to the appropriate system components. Because this type of air flow switch is dependent on air pressure, it typically must be disposed within the path of the air flow or user inhalation.

Another such example is a vacuum sensor, which does not measure air flow, but rather the absence thereof. In this configuration, when a user inhales, he applies suction to the smoking device 104 (in the case of FIG. 1) or tube 203 (in the case of FIG. 2), thereby causing a drop in pressure throughout the entire system. A diaphragm inside the vacuum sensor deforms in accordance with this drop in pressure and closes electrical contacts within the sensor, closing the circuit and sending power to the appropriate system components. As such, in some embodiments, the vacuum sensor can therefore be located off to the outside of the actual flow path of smoke and air—it does not have to be situated directly in line with the path of airflow. The vacuum sensor should be positioned so that it will not be in the path of vapor or draining liquid or condensation.

Yet another such example of an air flow switch is a microphone switch that has a sensor that detects the noise associated with air flow, and closes the circuit accordingly. Because this type of air flow switch is dependent on the flow of air across its sensor, it typically must be disposed within the path of the air flow or user inhalation.

It may be noted that electronic hookah 100 or 200 may optionally be functional for conventional hookah use, and may have either an external appearance similar to a conventional hookah or a different shape or external appearance. For example, the body may have the shape of a traditional hookah, or may have a flat or compact shape that is convenient for carrying and storage, or may have a shape that provides advertising or marketing value, or may have a shape that has cultural or social significance within a certain population. The body may be configured to provide access to its interior via one or more openings, enabling the insertion and or maintenance of the power supply or other components. Additionally, the body may provide an opening for external connector 218. As mentioned above, light 116 or 216 may illuminate in one color upon inhalation by any one user, or a different color for each user, and yet an additional color upon any two or more users inhaling simultaneously, the activation of which is controlled by light controller 111 or 211 which provides power to light 116 or 216.

It may be appreciated that by combining the benefits of electronic cigarette technology with the social and communal aspects of a hookah, the electronic hookah of the present invention can provide a social smoking alternative, enhancing the entertainment value of establishments while also complying with anti-smoking legislation. More simply, the electronic hookah may appeal to individuals and businesses as a more eco-friendly smoking alternative. The addition of various color lights which are activated upon inhalation further enhance the communal experience of the users.

While the present invention has been described within the context of the described embodiments, the description is intended to be illustrative of the invention as a whole, and is not to be construed as limiting. It is appreciated that various modifications may occur to those skilled in the art that, while not specifically shown herein, do not depart from the true spirit and scope of the invention.

Figure 1:
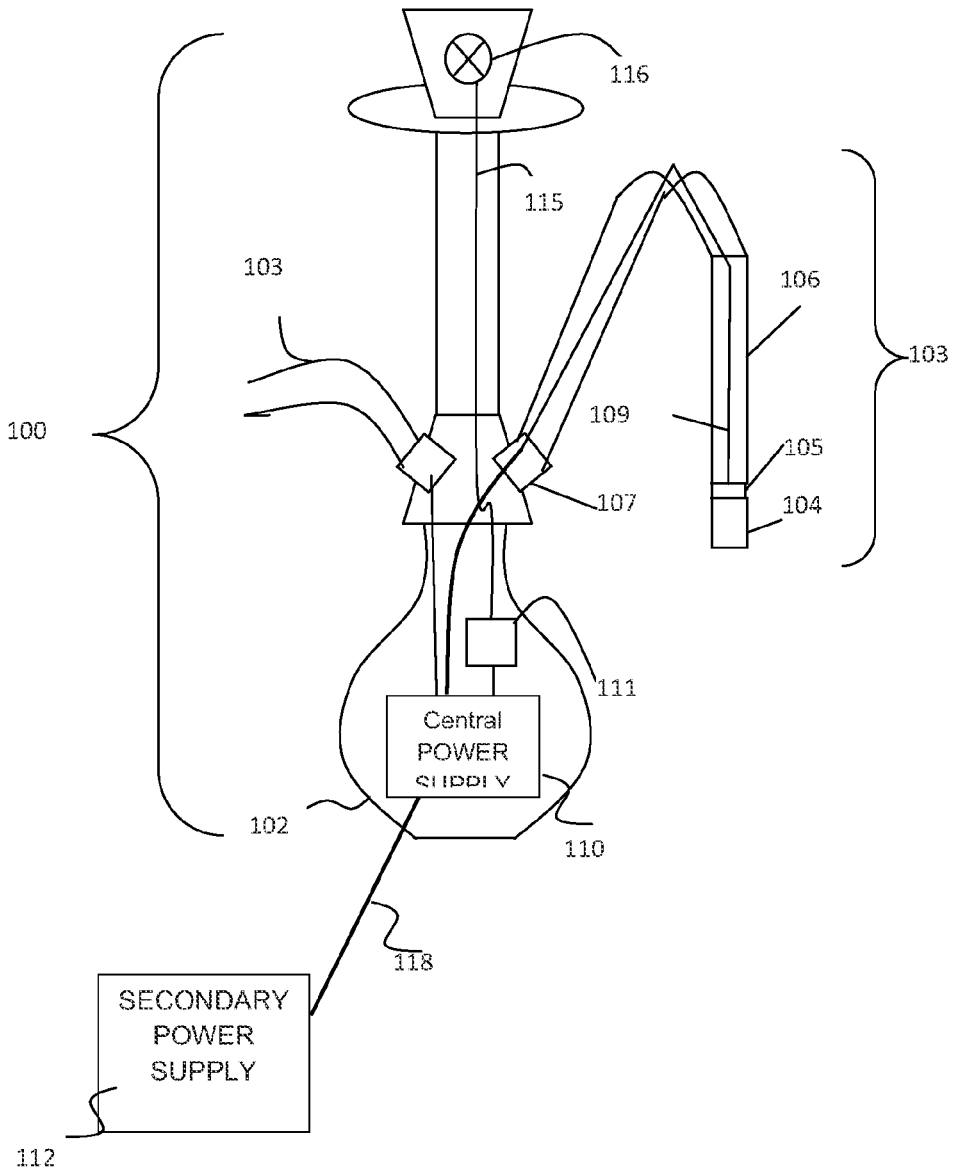
FIG. 1 is a schematic of an electronic hookah, constructed and operative in accordance with an embodiment of the invention in which there is a separate smoking device for each individual concurrent user.
Figure 2:
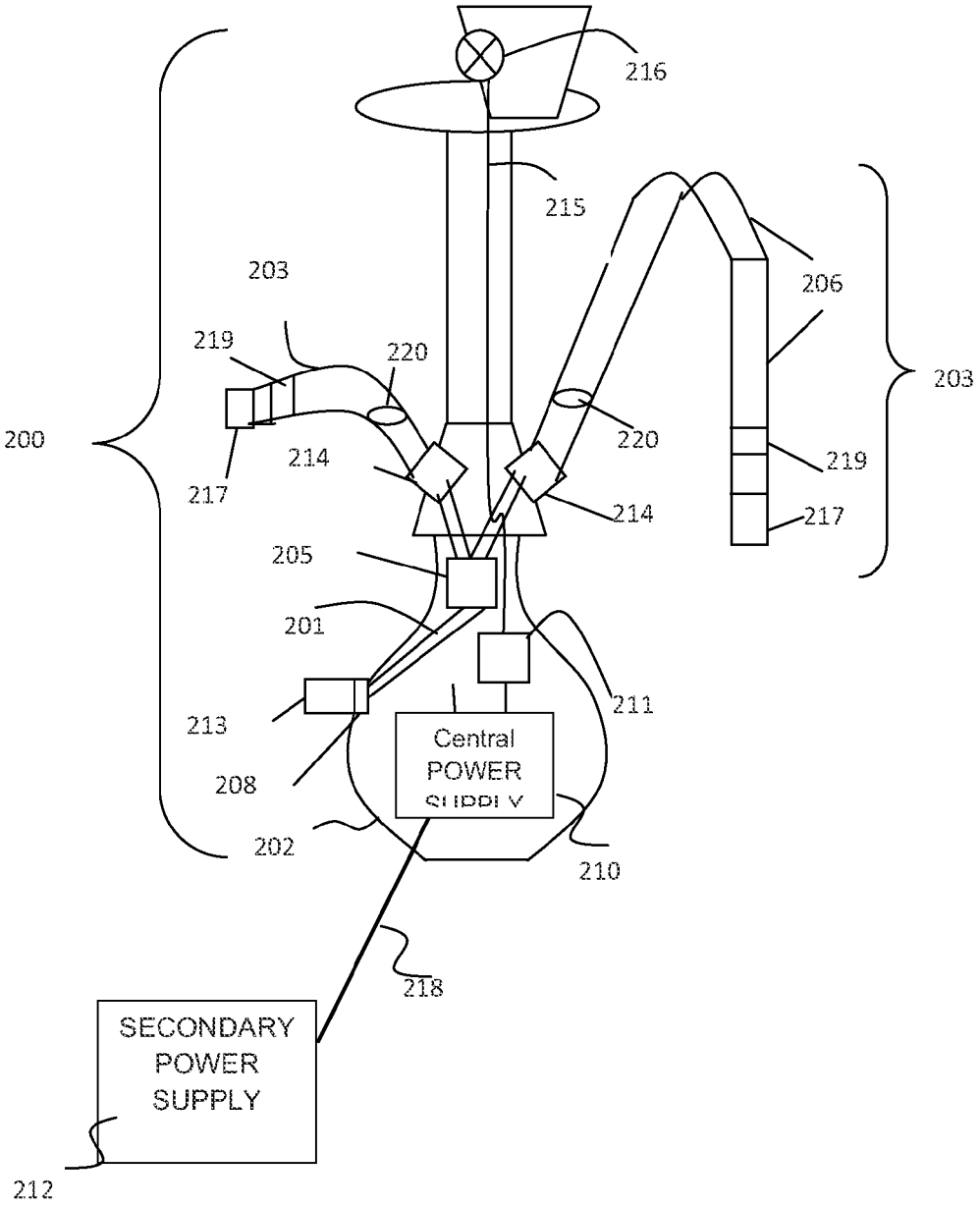
FIG. 2 is a schematic of an electronic hookah, constructed and operative in accordance with another embodiment of the invention in which all users share a single smoking device.

The invention claimed is:

1. An electronic hookah, comprising:
a body;
a central power supply in the body; and
two or more smoking units, each smoking unit connected to the body and comprising,
a tube fluidly connected to the body,
a connection socket on a distal end of the tube,
a power connector electrically connecting the central power supply to the connection socket,
a smoking device releasably connected to the connection socket and configured to vaporize smoke juice, the smoking device being electrically connected to the connection socket to allow electrical power to be sent from the central power supply over the power connector to the connection socket to the smoking device to vaporize the smoke juice, and
a switch in fluid communication with the tube, the switch configured to selectively allow the electrical power to be sent from the central power supply over the power connector to the connection socket.

2. The electronic hookah of claim 1, wherein said smoking device comprises a heating element, the smoking device defining a cavity configured to contain the smoke juice.

3. The electronic hookah of claim 2, wherein said smoke juice contains flavorings, coloring agents, nicotine, a vaporizing base, or combinations thereof.

4. The electronic hookah of claim 1, wherein the switch is activated by user inhalation from said smoking device, and when activated the switch is configured to allow the electrical power to be sent from the central power supply over the power connector to the connection socket.

5. The electronic hookah of claim 1, further comprising a light controller and a light, wherein said central power supply provides power to said light controller, and wherein upon activation of said switch by user inhalation from said smoking device, said light controller is triggered, sending momentary power to said light.

6. The electronic hookah of claim 1, wherein said two or more smoking units are detachable from said body.

7. The electronic hookah of claim 1, wherein said tube of said smoking unit is retractable into said body.

8. The electronic hookah of claim 1, wherein said central power supply is selected from the group consisting of: an AC to DC power converter, a universal serial bus (USB) power supply, a replaceable or rechargeable battery, and combinations thereof.

9. An electronic hookah comprising:
a body including a primary power supply;

a connection socket electrically connected to the primary power supply;

a smoking device releasably attached to the connection socket and configured to vaporize smoke juice, the smoking device being electrically connected to the connection socket to allow electrical power to be sent from the primary power supply through the connection socket to the smoking device to vaporize the smoke juice;

an air flow passage at least partially traversing through the body and being fluidly connected to the smoking device; and two or more tubes extending from the body and being in fluid communication with the air flow passage, each of the tubes including a disposable mouthpiece on a first end and an air flow switch on a second end, each air flow switch being configured to selectively allow the electrical power to be sent from the primary power supply to the connection socket.

10. The electronic hookah of claim 9, wherein said smoking device comprises a heating element, the smoking device defining a cavity configured to contain the smoke juice.

11. The electronic hookah of claim 10 wherein said smoke juice contains flavorings, coloring agents, nicotine, a vaporizing base or combinations thereof.

12. The electronic hookah of claim 9, wherein the air flow switch is activated by user inhalation from said mouthpiece, and when activated the air flow switch is configured to allow the electrical power to be sent from the primary power supply to the connection socket.

13. The electronic hookah of claim 9, further comprising a light controller and a light, wherein said primary power supply provides power to said light controller, and wherein upon activation of said air flow switch by user inhalation from said mouthpiece, said light controller is triggered, sending momentary power to said light.

14. The electronic hookah of claim 9, wherein said two or more tubes are detachable from said body.

15. The electronic hookah of claim 9, wherein each tube is retractable into said body.

16. The electronic hookah of claim 9, wherein said primary power supply is selected from the group consisting of: an AC to DC power converter, a universal serial bus (USB) power supply, a replaceable or rechargeable battery, and combinations thereof.

17. The electronic hookah of claim 9, further comprising a secondary power supply configured to charge said primary power supply.

18. The electronic hookah of claim 9, further comprising a drainage tray disposed between said mouth piece and said air flow switch adapted to collect condensed electronic vapor.

19. The electronic hookah of claim 9, further comprising an air flow check valve disposed between said mouth piece and said air flow switch adapted to allow said vapor to flow in only one direction.

* * * * *